United States Patent [19]

Gunnergaard

[11] 3,996,996

[45] Dec. 14, 1976

[54] APPARATUS FOR THE PRODUCTION OF CASTINGS

[75] Inventor: Marius Gunnergaard, Lyngby, Denmark

[73] Assignee: Dansk Industri Syndikat A/S, Herlev, Denmark

[22] Filed: Aug. 27, 1975

[21] Appl. No.: 608,335

[30] Foreign Application Priority Data

Sept. 11, 1974 Denmark ..... 4797/74

[52] U.S. Cl. ..... 164/323; 164/130; 164/335

[51] Int. Cl.[2] ..... B22C 9/20

[58] Field of Search ..... 164/323, 335, 322, 130

[56] References Cited

UNITED STATES PATENTS 2,230,845 2/1941 Oakey ..... 164/323 X

FOREIGN PATENTS OR APPLICATIONS 47-50966 12/1972 Japan ..... 164/130

*Primary Examiner*—Travis S. McGehee
*Attorney, Agent, or Firm*—Imirie, Smiley & Linn

[57] ABSTRACT

In a casting apparatus using a mould which comprises a horizontal series of identical mould parts and presents at least one casting cavity at each joint between successive mould parts, the mould is advanced stepwise through a pouring station including a pouring sow, the bottom of which rests on the top surface of the mould and has at least one outlet to successively communicate with the inlets of the casting cavities of the mould during the stepwise advance thereof.

7 Claims, 2 Drawing Figures

APPARATUS FOR THE PRODUCTION OF CASTINGS

BACKGROUND OF THE INVENTION

The invention relates to an apparatus for the production of castings, which apparatus in a manner known per se comprises a device for the successive production of identical mould parts and a pouring track or guideway on which the mould parts are placed together so as to form a continuous casting mould which at each joint has at least one pouring cavity with an upwardly open inlet and which is advanced stepwise through a pouring station. After the pouring, the mould can be advanced further through a cooling path of a suitable length to a knocking-out station.

Where it is a question of producing comparatively small castings, the pouring can be performed manually by means of conventional ladles, but the normal procedure is to use a suspended ladle of a suitably large capacity, and in order in this case to avoid waste of molten metal some care must be exercised both as regards the adjustment of the ladle in relation to the inlet of the casting mould and as regards the dosage of the quantity of metal for each inlet.

SUMMARY OF THE INVENTION

The drawbacks in this respect have to a wide extent been reduced by the use of the apparatus of the present invention which is characterized in that at the pouring station a pouring sow is provided the bottom of which is held in sliding engagement with the top of the casting mould and is provided with an outlet to successively communicate with the inlets of the mould, the said sow being adjustable in the longitudinal direction of the pouring track or guideway and preferably also in its transverse direction.

During the advance of the casting mould in relation to the pouring sow, the bottom of the latter rests so as to be sealed tightly against the top of the mould which by this means blocks the lower end of the outlet of the sow, but when this outlet communicates with the inlet to a pouring cavity, the latter is automatically filled from the sow. Discharge of metal from the sow ceases when the pouring cavity and the inlet of the latter have been filled, and consequently there is no dosage problem.

The pouring sow may be movable together with the casting mould for part of the length of the advance step of the latter, after the inlet to a pouring cavity has entered into communication with the bottom outlet of the sow, but this will require a rather complicated control of the movement of the sow forwards and backwards in the longitudinal direction of the pouring track or guideway. It is considerably simpler to let the pouring sow be stationary during the pouring operation, but in this case it is a condition of the correct functioning that during its stepwise advance the casting mould stops with an inlet aligned with the bottom outlet of the pouring sow. This is the background for the pouring sow being adjustable in the longitudinal direction of the pouring track or guideway, since in this case due regard can be paid not only to differences in thickness, if any, between otherwise identical mould parts, but also to the differences in thickness which will usually occur in the case of a switch from one type of mould parts to another.

As mentioned above, the pouring sow is intended for engaging the top of the casting mould with a tight fit, and consequently a considerable wear of the bottom during the operation of the plant must be taken into consideration. Regard to this may be paid when the material for the pouring sow is chosen, but, in addition, the sow may further be supported by springs for reducing its contact pressure against the casting mould. By this means the wear is reduced correspondingly and, in addition, the risk of particles of sand from the casting mould being torn off and carried along is reduced.

Although in the foregoing only a single bottom outlet in the pouring sow has been referred to, such outlets may be provided according to the actual circumstances. The shape and size of the outlets may correspond approximately to a casting mould inlets, but this is no necessity. The sole condition is that the necessary quantity of metal can be poured into the mould in the course of the time at disposal.

The invention will now be more fully explained with reference to the accompanying drawing.

DESCRIPTION OF THE PREFERRED EMBODIMENT

Figure 1:
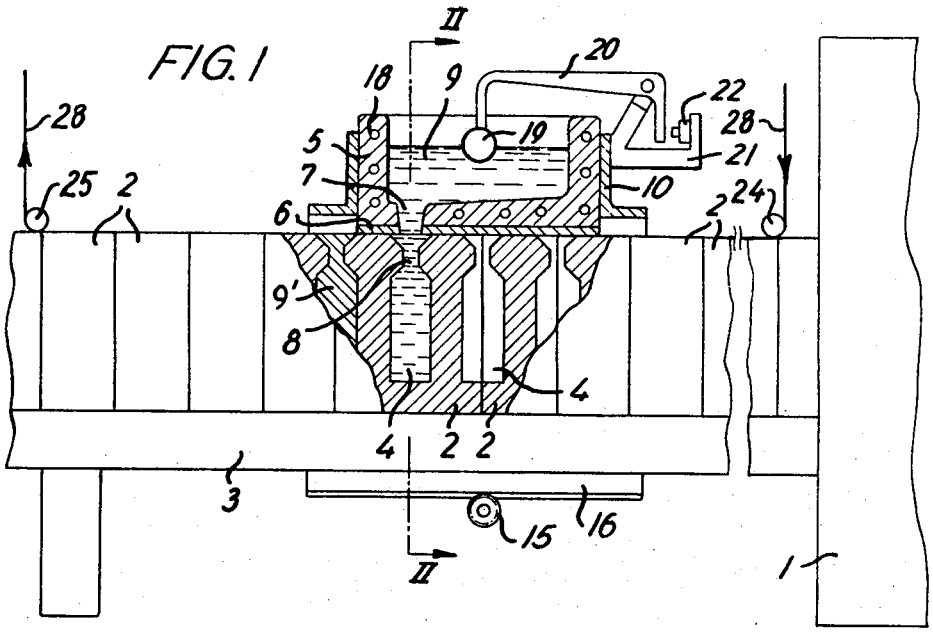
FIG. 1 is a diagrammatic side elevational view, partly in section, through the relevant parts of an embodiment of the casting apparatus of the invention
Figure 2:
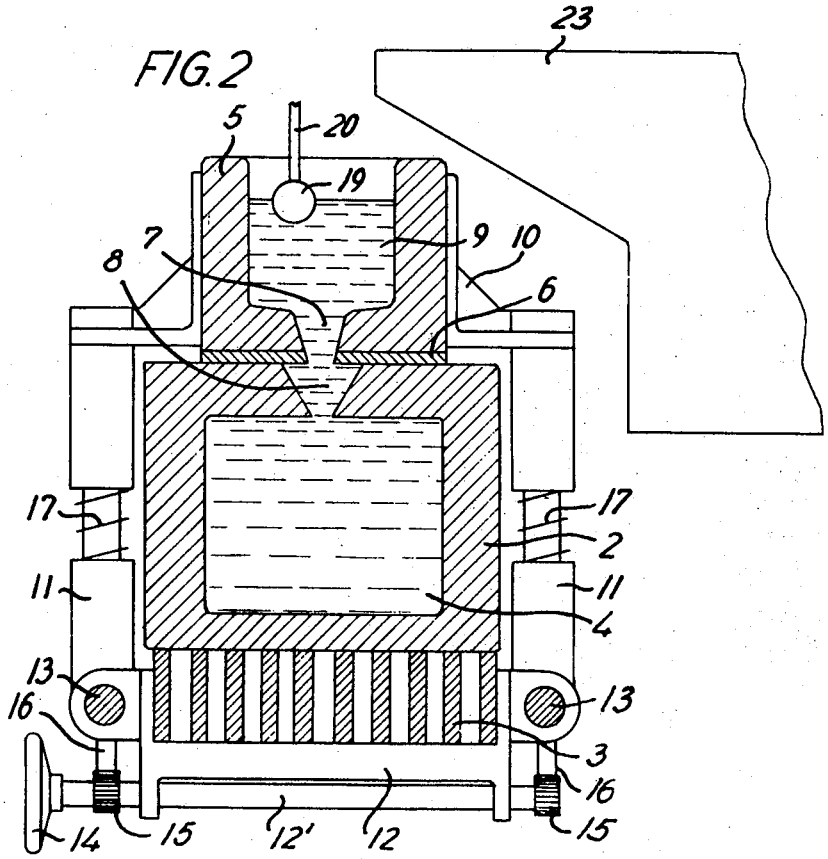
FIG. 2 is a diagrammatic cross-sectional view on a slightly larger scale and taken along line II—II of FIG. 1.

The apparatus as disclosed in FIG. 1 comprises a device 1 for the production of identical mould parts 2 which are successively led out onto a pouring track or guideway 3 and are on the latter placed together so as to form a continuous casting mould comprising one or more pouring cavities 4 at each joint in the mould. The latter is advanced stepwise on the guideway 3 which may be designed as a kind of travelling grate as indicated in FIG. 2. During this travel, the mould passes through a pouring station and arrives at a knocking-out station, not shown, after a suitable cooling.

At the pouring station a pouring sow 5 is provided which comprises a sole 6 of wear-resisting material resting slidingly on the top of the casting mould 2, and having a bottom outlet 7 which successively communicates with the inlets 8 of the pouring cavities 4. When such a communication has been established, molten metal 9 will run down into the pouring cavity and form the casting 9′, and at the subsequent advance of the mould the communication will again be interrupted, after which the bottom outlet is kept blocked by the top of the mould until the next inlet 8 has advanced to and is located below the outlet of the pouring sow.

It ought to be a relatively easy matter to replace the pouring sow 5, inter alia since from time to time it is necessary to line it with a suitable lining material, and, as shown, it may expediently be mounted releasably in an upper frame 10 which via vertical columns 11 is supported by a lower frame 12, FIG. 2, which from below encloses the guideway 3. This lower frame 12 is carried by a pair of horizontal guide rails 13 and is displaceable thereon. As illustrated, in the frame 12 a shaft 12′ has been journalled which is provided with a hand wheel 14 and a pair of gear wheels 15 meshing with stationary toothed racks 16. By this means, a regulation or adjustment of the pouring sow 5 in the longitudinal direction of the mould 2 is made possible to ensure that the outlet 7 is located above a mould inlet 8 when the mould is stationary.

In addition, the pouring sow may be adjustable in the transverse direction of the pouring track or guideway. By this means, regard can be paid to the fact that the placing of the mould inlets in this direction may be different in different casting moulds, e.g. dependent on the shape of the castings.

As shown in FIG. 2, the vertical guide columns 11 may be variable in length and contain compression springs 17 for reducing the contact pressure between the sole 8 of the pouring sow and the casting mould.

The material of the pouring sow should be heat-insulating to a suitable degree, but, particularly out of regard to periods of stoppage during the operation, there should in addition be the possibility of a supply of extra heat for maintaining a constant temperature of the molten metal. In FIG. 1 this has been indicated by electric heating elements 18 being provided in the wall and bottom of the pouring sow.

In the embodiment shown, the level in the pouring sow is sensed by means of a float 19 on a bell crank 20 which is carried rotatably by a bracket 21 on the frame 10 and serves for actuating a switch 22 when the level becomes lower than a certain value. This causes the actuation of a tiltable heat preservation furnace 23, FIG. 2, which serves as supply container for the refilling of the pouring sow 5 as required.

During the operation of the apparatus, sand particles may unintentionally be torn off from the upper surface of the mould 2 and drop down into the casting cavities 4. In order to eliminate this risk, a strip 28 of flexible sheet material, such as paper, plastic or metal foil, may be fed to the upper side of the mould via a guide roller 24 so as to move through the pouring station together with the mould and may be removed therefrom by passing over a second guide roller 25. The portions of the strip 28 covering the cavity inlets 8 will be burnt away or otherwise disappear due to the heat from the molten metal 9 passing through the outlet 7 of the sow.

Alternatively, the upper surface of the mould could be covered by graphite powder or another friction reducing material, or the mould surface could be stabilized by application of a rapidly hardening binder.

What is claimed is:

1. An apparatus for the production of castings in a mould consisting of a continuous series of identical sand mould parts and presenting, at each vertical joint between successive mould parts, at least one mould cavity having a pouring inlet extending upwardly to the top surface of the mould, comprising a straight horizontal guideway forming a support for the mould and permitting a stepwise advancement thereof, a pouring sow provided above said guideway and having a bottom resting slidingly on said top surface and presenting at least one outlet, means to adjust the position of said pouring sow with respect to said mould such that said outlet communicates successively with the inlets of the mould in the periods of stand-still between successive advancements thereof to automatically deliver a charge of molten casting material from said pouring sow to said mould cavities, and means to prevent sand particles from becoming dislodged from said top surface of the mould by frictional engagement thereof with said pouring sow bottom whereby said cavities may be successively filled without damage to the mould or contamination to the castings.

2. An apparatus as claimed in claim 1, further including springs disposed on said position adjusting means and supporting said pouring sow for reducing contact pressure thereof against the top surface of the casting mould.

3. An apparatus as claimed in claim 1 wherein said pouring sow includes electric heating means disposed in the walls thereof.

4. An apparatus as claimed in claim 1 further including a supply of moulten material, and means responsive to the level of moulten material in said pouring sow falling below a predetermined level to dispense material from said supply to said pouring sow.

5. An apparatus as claimed in claim 1 wherein said particle dislodgement preventing means comprises a strip of flexible sheet material disposed on the top surface of said mould.

6. An apparatus as claimed in claim 1 wherein said particle dislodgement preventing means comprises a hardenable binder applied to the top surface of said mould.

7. An apparatus as claimed in claim 1 wherein said particle dislodgement preventing means comprises a layer of friction reducing material applied to the top surface of said mould.

* * * * *